US011988079B2

(12) United States Patent
Prisbell et al.

(10) Patent No.: US 11,988,079 B2
(45) Date of Patent: May 21, 2024

(54) PRESSURE BULKHEAD

(71) Applicant: Schlumberger Technology Corporation, Sugar Land, TX (US)

(72) Inventors: Andrew Prisbell, Sugar Land, TX (US); Erick Lowe, Houston, TX (US); Bhagyashri Walse, Dhanori (IN); Jay Garza, La Marque, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 75 days.

(21) Appl. No.: 17/819,396

(22) Filed: Aug. 12, 2022

(65) Prior Publication Data

US 2023/0046639 A1 Feb. 16, 2023

Related U.S. Application Data

(60) Provisional application No. 63/260,193, filed on Aug. 12, 2021.

(51) Int. Cl.
*E21B 43/1185* (2006.01)
*E21B 43/119* (2006.01)

(52) U.S. Cl.
CPC ..... *E21B 43/119* (2013.01); *E21B 43/1185* (2013.01)

(58) Field of Classification Search
CPC ..... E21B 43/1185; E21B 43/119; F42D 1/04
See application file for complete search history.

(56) References Cited

U.S. PATENT DOCUMENTS

| | | | | |
|---|---|---|---|---|
| 4,003,620 | A * | 1/1977 | O'Brien | H01R 13/523 439/204 |
| 4,174,145 | A * | 11/1979 | Oeschger | H01R 13/521 439/589 |
| 4,960,391 | A * | 10/1990 | Beinhaur | H01B 17/305 439/935 |
| 9,145,764 | B2 * | 9/2015 | Burton | H02G 9/00 |
| 10,502,048 | B2 * | 12/2019 | Lee | G01V 3/28 |
| 10,844,697 | B2 | 11/2020 | Preiss et al. | |
| 10,954,723 | B2 * | 3/2021 | Sullivan | F16L 37/26 |
| 11,339,614 | B2 * | 5/2022 | Mulhern | E21B 17/028 |
| 11,713,625 | B2 * | 8/2023 | Eitschberger | E21B 17/0285 166/65.1 |
| 11,867,032 | B1 * | 1/2024 | Parks | E21B 43/1185 |

(Continued)

FOREIGN PATENT DOCUMENTS

WO 2020016255 A1 1/2020

OTHER PUBLICATIONS

Search Report and Written Opinion of International Patent Application No. PCT/US2022/040152 dated Nov. 24, 2022, 11 pages.

*Primary Examiner* — Kenneth L Thompson
(74) *Attorney, Agent, or Firm* — Jeffrey D. Frantz

(57) ABSTRACT

A perforation tool, and a bulkhead member for a perforation tool, are disclosed. The perforation tool has a loading tube, an initiator module, and a bulkhead member connected between the loading tube and the initiator module. The bulkhead member has a hollow body member with a central transverse plate having a central bore through the transverse plate along a longitudinal axis of the body member and an electrical conductor disposed in the central bore, the electrical conductor having a pin connection at a first end thereof and a box connection at a second end thereof.

10 Claims, 2 Drawing Sheets

(56) References Cited

U.S. PATENT DOCUMENTS

| | | | |
|---|---|---|---|
| 2017/0030693 | A1 | 2/2017 | Preiss et al. |
| 2019/0293398 | A1 | 9/2019 | Eitschberger |
| 2020/0199983 | A1 | 6/2020 | Preiss et al. |
| 2021/0207934 | A1 | 7/2021 | Sullivan et al. |

* cited by examiner

PRESSURE BULKHEAD

CROSS-REFERENCE TO RELATED APPLICATIONS

This patent application claims benefit of U.S. Provisional Patent Application Ser. No. 63/260,193 filed Aug. 12, 2021, which is entirely incorporated herein by reference.

FIELD

This patent application addresses hardware for stimulating hydrocarbon reservoirs. Specifically described herein is hardware for perforating wells drilled into geologic formations.

BACKGROUND

Hydrocarbon reservoirs are commonly stimulated to increase recovery of hydrocarbons. Hydraulic fracturing, where a fluid is pressurized into the reservoir at a pressure above the fracture strength of the reservoir, is commonly practiced. In most fracturing practice, a well is drilled into the formation and a casing formed on the outer wall of the well. The casing is then perforated using explosives to form holes in the casing that can extend a short distance into the formation from the well wall. The hardware for perforating wells is in continual need of simplification and cost reduction.

SUMMARY

Embodiments described herein provide a bulkhead member for a perforation tool, the bulkhead member comprising a hollow body member with a central transverse plate having a central bore through the transverse plate along a longitudinal axis of the body member; and an electrical conductor disposed in the central bore, the electrical conductor having a pin connection at a first end thereof and a box connection at a second end thereof.

Other embodiments described herein provide a bulkhead member for a perforation tool, the bulkhead member comprising a hollow body member with an outer shell, a first end, a second end, and a central transverse plate located between the first end and the second end, the central transverse plate having a central bore through the transverse plate along a longitudinal axis of the body member, wherein the central transverse plate has a thickness greater than a thickness of the outer shell, and the outer shell has a different thickness at the first end and the second end; and an electrical conductor disposed in the central bore, the electrical conductor having a pin connection at a first end thereof and a box connection at a second end thereof.

Other embodiments described herein provide a perforation tool, comprising a loading tube for holding charges; an initiator module for initiating discharge of the perforation tool; and a bulkhead member for connecting between the loading tube and the initiator module, the bulkhead member comprising a hollow body member with a central transverse plate having a central bore through the transverse plate along a longitudinal axis of the body member; and an electrical conductor disposed in the central bore, the electrical conductor having a pin connection at a first end thereof and a box connection at a second end thereof.

DETAILED DESCRIPTION

Figure 1A:
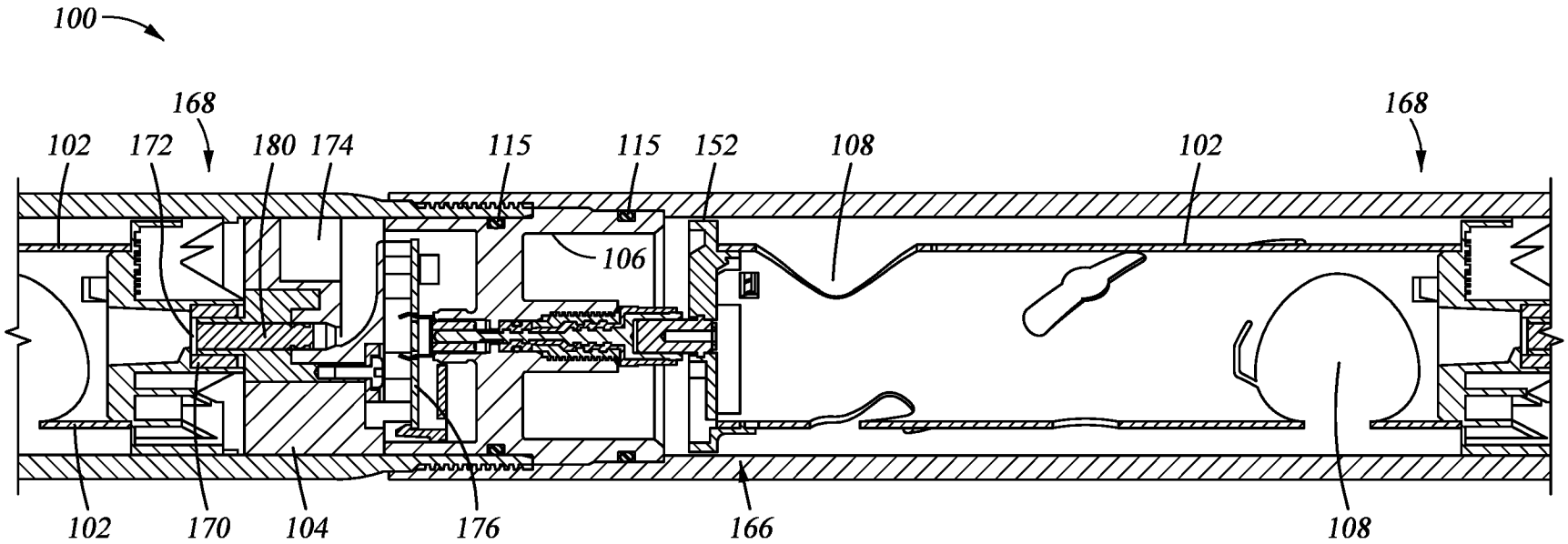
FIG. 1A is a cross-sectional view of a perforation apparatus according to one embodiment.

FIG. 1A is a cross-sectional view of a perforation apparatus 100 according to one embodiment. The perforation apparatus 100 has a loading tube 102 for holding explosive charges, an initiator module 104 that initiates discharge of the explosive charges, and a bulkhead member 106 that separates the explosive charges of the loading tube 102 from sensitive electronics in the initiator module 104. The loading tube 102 has a plurality of recesses 108 for receiving explosive charges and orienting the charges in a phased orientation.

Figure 1B:
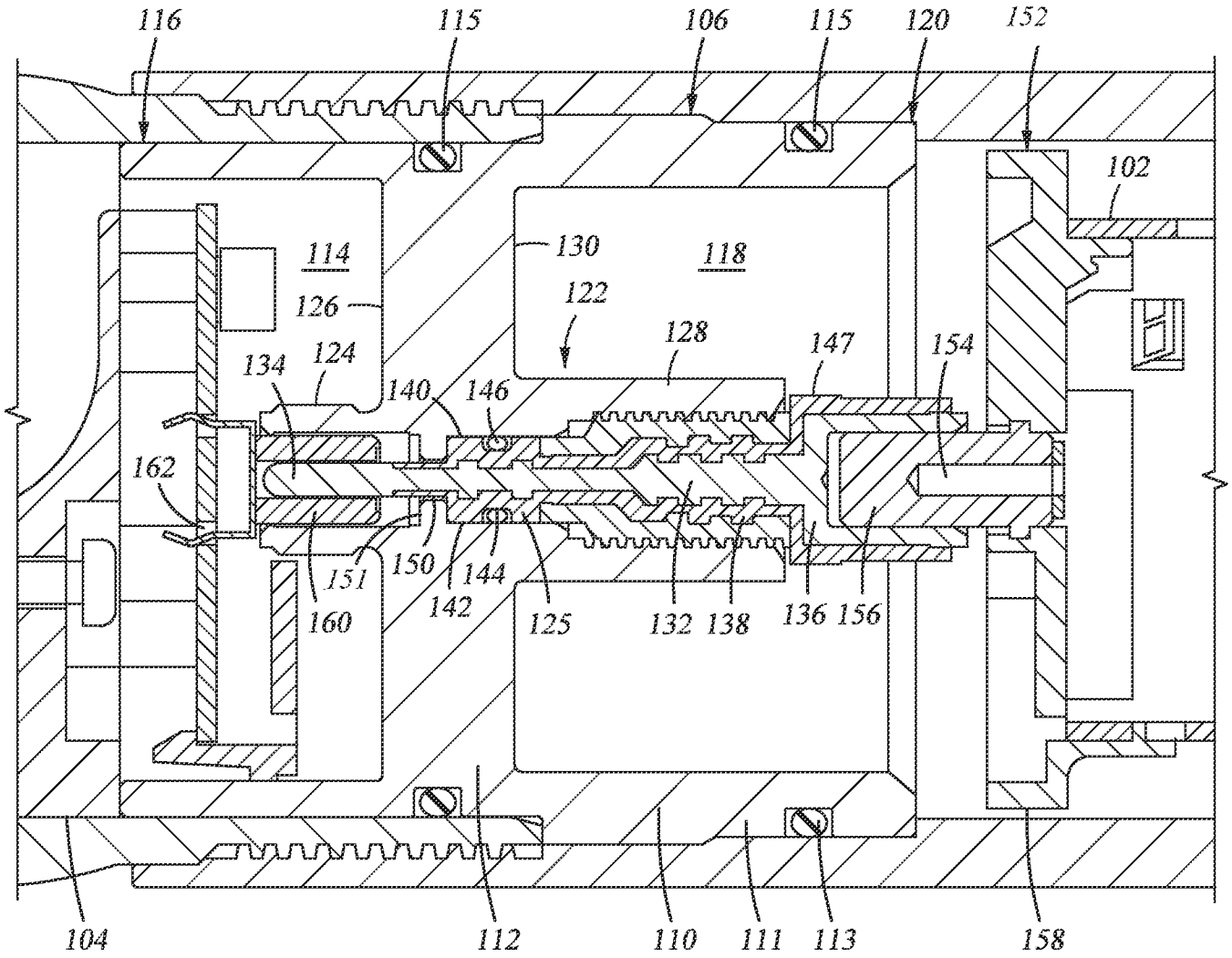
FIG. 1B is a detail cross-sectional view of a portion of the perforation apparatus of FIG. 1A.

FIG. 1B is a detail view of the bulkhead member 106 of FIG. 1A. The bulkhead member 106 has a generally cylindrical body 110, or a shape conducive to housing in a desired casing. The body 110 of the bulkhead member 106 may be solid, or may be mostly hollow, as in this case. Here, the body 110 has an outer shell 111 with a central plate 112 transverse to a longitudinal axis of the body 110. The outer surface of the outer shell 111 has conveniently placed grooves 113 to receive seal members 115 for sealing against an outer casing. The central plate 112, which in this case has a thickness greater than thickness of the outer shell 111, provides structural support for components of the bulkhead member 106, while the hollow configuration of the body 110 reduces weight, and reduces pressure within the bulkhead member 106 when a ballistic source detonates. Reducing pressure within the bulkhead member 106 upon detonation of a ballistic source can prevent cracking of the bulkhead member 106.

The central plate 112 defines a first cavity 114, generally facing a first end 116 of the body 110, and a second cavity 118, generally facing a second end 120 of the body 110. The central plate 112 separates the first cavity 114 from the second cavity 118 such that when the bulkhead member 106 is assembled into a perforating tool, the first cavity 114 faces a first tool member and the second cavity 118 faces a second tool member. In the case of FIG. 1A, the first cavity 114 faces the initiator module 104 and the second cavity 118 faces the loading tube 102.

The central plate 112 supports a feedthrough 122, which provides a conduit for electrical conductivity from the first end 116 to the second end 120 of the bulkhead member 106. The feedthrough 122 has a central bore 125, oriented along the longitudinal axis of the bulkhead member 106, that extends through the central plate 112 from the first cavity 114 to the second cavity 118. A first protrusion 124 extends from a first side 126 of the central plate 112 into the first cavity 114, and a second protrusion 128 extends from a second side 130 of the central plate 112 into the second cavity 118. The central bore 125 extends along and within the first protrusion 124, through the central plate 112, and along and within the second protrusion 128 to provide a pathway through the central plate 112 from the first cavity 114 to the second cavity 118.

An electrical conductor 132 is disposed in the central bore 125 to provide electrical conductivity from the first end 116 to the second end 120 of the bulkhead member 106. The electrical conductor 132 has a pin connection 134 at a first end thereof and a box connection 136 at a second end thereof opposite from the first end. When the electrical conductor 132 is installed in the bulkhead member 106, the pin connection 134 is disposed in the first protrusion 124 and the box connection 136 extends beyond the second protrusion 128. The electrical conductor 132 is a rod-like member that extends from the pin connection 134 at the first end to the box connection 136 at the second end. The box connection 136 is a hollow cylindrical feature with diameter larger than a diameter of the rest of the electrical conductor 132 so that the box connection 136 can receive an electrical connector of another tool into the hollow cylindrical box connection 136. In some embodiments, the box connection 136 may be described as a "female" electrical connection, while the pin connection 134 may be described as a "male" electrical connection.

An electrical insulator 138 is disposed within the central bore 125 around the electrical conductor 132 to prevent electrical connection between the electrical conductor 132 and the body 110. The body 110 is typically made of steel to provide pressure insulation between the loading tube 102, where the charges discharge, and the initiator module 104, where sensitive electronics are located to control operation of the tool. In some embodiments, where the body 110 can be made from a dense, hard, non-conducive material, such as hard plastic, the electrical insulator 138 might not be needed. The electrical insulator 138 has a seal portion 140 that inserts into a throat 142 of the central bore that extends into the central plate 125. The seal portion 140 has a groove 144 that accommodates a seal member 146 to provide a secure fit for the electrical conductor 132 within the central bore 125. The electrical insulator 138 extends from the seal portion 140 to an entry portion 147 that houses the box connection 136 of the electrical conductor 132. The entry portion 147 has a shape similar to the shape of the box connection 136, in this case a hollow cylindrical shape with an inner diameter approximately equal to an outer diameter of the box connection 136 so that an inner surface of the electrical insulator 138 contacts an outer surface of the box connection 136. The entry portion 147 of the electrical insulator 138 extends to a location adjacent to an end of the box connection 136, so the electrical insulator 138 extends from a location adjacent to the end of the box connection 136 into the annular gap 150, contacting the electrical conductor 132 at every location along the length of the electrical insulator 138. The seal members 115 and 146 provide pressure seal against the hydrostatic pressure of the well environment, as well as pressure seal between adjacent tools.

The electrical conductor 132 extends beyond the seal portion 140 of the electrical insulator 138 through the central plate 112, where the central bore 125 defines an annular gap 150 around the electrical conductor 132. A wall 151 extends radially inward from an interior wall of the central bore 125 toward the electrical conductor 132 to define the gap 150. The central bore 125 has a diameter that increases as the central bore 125 extends away from the gap 150 toward the first end 116 and the second end 120. In other words, the central bore 125 has a minimum diameter at the gap 150. The electrical conductor 132 further extends into the first protrusion 124 to the pin connection 134. The electrical insulator 138 thus extends from the box connection 136 partway along the length of the electrical conductor 132 into the annular gap 150. Each of the electrical insulator 138 and the electrical conductor 132 extends beyond the second protrusion into the second cavity 118 and beyond the second end of the body 110 to provide an accessible electrical connection to accommodate another tool.

The first end 116 and the second end 120 of the outer shell have different thicknesses, in this case. The outer shell 111 has a first thickness at the first end 116 and a second thickness at the second end 120. The first thickness is less than the second thickness in this case. Here, the first end 116 faces the initiator module 104 and the second end 120 faces the loading tube 102. The larger thickness of the outer shell 111 at the second end 120 can withstand discharge of the shaped charges disposed in the loading tube 102, and the smaller thickness of the outer shell 111 at the first end 116 can withstand the smaller discharge of the detonator in the initiator module 104. The thickness of the central transverse plate 112 also serves to protect electronic components of the initiator module 104 from energy of the discharge of the shaped charges disposed in the loading tube 102.

In FIG. 1B, the loading tube 102 has a connector 152 that can be inserted into the box connection 136 of the bulkhead member 106. The connector 152 has a metal pin 154 and a metal stub 156 over the metal pin 154, with an overmolded plastic body 158 that locates the metal pin 154 and metal stub 156 at the end of the loading tube 102. Inserting the metal stub 156 into the box connection 136 of the bulkhead member 106 establishes electrical connection between the bulkhead member 106 and the loading tube 102.

A plug connector 160 is disposed within the end of the first protrusion 124 around the pin connection 136 of the electrical conductor 132. The plug connector 160 provides electrical connection to a wire contact 162 of the initiator module 104. The plug connector 160 can be an RCA connector, or another convenient type of connector. The wire contact 162 connecting with the plug connector 160 electrically connects the bulkhead member 106 with the initiator module 104. In this way, electrical connection is established from the initiator module 104, through the bulkhead member 106, to the loading tube 102.

Returning to FIG. 1A, electrical conductivity is established along the loading tube 102 by connecting a wire (not shown) to the connector 152. The connector 152 is a first connector of the loading tube 102, located at a first end 166 thereof. The loading tube 102 has a second connector 164 located at a second end 168 thereof, opposite from the first end. The wire is connected from the first connector 152 to the second connector 164, traversing the length of the loading tube 102 according to any convenient path.

A second loading tube 102 is shown in FIG. 1A to illustrate connection of the loading tube 102, at the second end 168 thereof, to the initiator module 104. A band connector 170 is disposed in a central recess 172 of the second connector 164. The band connector 170 makes electrical contact with a housing 174 of the initiator module 104. The housing provides electrical connection to the wire contact 162 (FIG. 1B) of the initiator module 104 and a circuit board 176 disposed at an end of the initiator module 104 that connects to the bulkhead member 106, and oriented generally transverse to the longitudinal axis of the perforation tool 100. Alternately, in embodiments where the housing 174 is made of a non-conductive material, an electrical contact can be provided for connecting with the band connector 170, and an electrical conductor can be routed through the housing 174*d* for connection with the wire contact 162 and the circuit board 176.

In operation a detonator 180 is disposed in a recess of the initiator module 104. The detonator 180 extends into the central recess 172 of the second connector 164 of the loading tube 102. A booster (not shown) is also disposed in the central recess 172 of the second connector 164. Detonation cord is connected to the booster and routed along the loading tube 102 to the charges held therein. An electrical signal received at the circuit board 176, causes the circuit board to send an electrical signal that activates the detonator 180, which in turn discharges the booster. The ballistic discharge of the booster is transmitted by the detonation cord to the charges held in the loading tube 102.

While the foregoing is directed to embodiments of the present invention, other and further embodiments of the present disclosure may be devised without departing from the basic scope thereof, and the scope thereof is determined by the claims that follow.

We claim:

1. A bulkhead member for a perforation tool, the bulkhead member comprising:

a hollow body member with an outer shell, a first end, a second end, and a central transverse plate located between the first end and the second end, the central transverse plate having a central bore through the central transverse plate along a longitudinal axis of the hollow body member, wherein the central transverse plate comprises at least one protrusion that extends along the longitudinal axis of the hollow body member and within the hollow body member, and wherein the central transverse plate has a thickness greater than a thickness of the outer shell, and the outer shell has a different thickness at the first end and the second end; and an electrical conductor disposed in the central bore, the electrical conductor having a pin connection at a first end thereof and a box connection at a second end thereof.

2. The bulkhead member of claim 1, wherein the electrical conductor and the central bore define an annular gap around the electrical conductor at the central transverse plate.

3. The bulkhead member of claim 2, where a wall extends inward from the central bore toward the electrical conductor to form the annular gap.

4. The bulkhead member of claim 3, wherein the central bore has a minimum diameter at the annular gap.

5. The bulkhead member of claim 4, further comprising an electrical insulator disposed around the electrical conductor in the central bore.

6. The bulkhead member of claim 5, wherein the electrical insulator contacts the electrical conductor at every location along length of the electrical insulator from a location adjacent to an end of the box connection into the annular gap.

7. The bulkhead member of claim 6, wherein the box connection has an inner diameter larger than an outer diameter of the electrical conductor.

8. The bulkhead member of claim 7, wherein the central transverse plate has a thickness greater than a thickness of the outer shell.

9. The bulkhead member of claim 1, wherein the at least one protrusion comprises a first protrusion extending from a first side of the central transverse plate and a second protrusion extending from a second side of the central transverse plate, opposite from the first side, and the central bore extends along and within the first protrusion, through the central transverse plate, and along and within the second protrusion.

10. The bulkhead member of claim 1, wherein the pin connection resides within the at least one protrusion.

* * * * *